US011534638B2

(12) United States Patent
Kinnunen

(10) Patent No.: US 11,534,638 B2
(45) Date of Patent: Dec. 27, 2022

(54) NOZZLE AND SPACING PLATE

(71) Applicant: Aquapix Oy, Kangasala (FI)

(72) Inventor: Kauko Kinnunen, Palokka (FI)

(73) Assignee: Firex Oy, Lahti (FI)

( * ) Notice: Subject to any disclaimer, the term of this patent is extended or adjusted under 35 U.S.C. 154(b) by 541 days.

(21) Appl. No.: 16/308,399

(22) PCT Filed: Jun. 12, 2017

(86) PCT No.: PCT/EP2017/064216
§ 371 (c)(1),
(2) Date: Dec. 7, 2018

(87) PCT Pub. No.: WO2017/216081
PCT Pub. Date: Dec. 21, 2017

(65) Prior Publication Data

US 2019/0269951 A1 Sep. 5, 2019

(30) Foreign Application Priority Data

Jun. 13, 2016 (EP) ..... 16174161

(51) Int. Cl.
*A62C 31/05* (2006.01)
*B05B 1/14* (2006.01)
(Continued)

(52) U.S. Cl.
CPC ..... *A62C 31/05* (2013.01); *A62C 37/11* (2013.01); *A62C 99/0072* (2013.01); *B05B 1/14* (2013.01); *B05B 7/0892* (2013.01)

(58) Field of Classification Search
CPC ..... A62C 31/05; A62C 31/02; A62C 31/28; A62C 37/11; A62C 99/0072; A62C 35/58;
(Continued)

(56) References Cited

U.S. PATENT DOCUMENTS 3,806,039 A 8/1974 Mocarski
3,838,815 A * 10/1974 Rice ..... F25C 3/04 239/14.2
(Continued)

FOREIGN PATENT DOCUMENTS

CN 1964793 A 5/2007
CN 203417419 U 2/2014
(Continued)

OTHER PUBLICATIONS

International Search Report for PCT/EP2017/064216 dated Aug. 18, 2017.
(Continued)

*Primary Examiner* — Christopher R Dandridge
(74) *Attorney, Agent, or Firm* — FisherBroyles, LLP

(57) ABSTRACT

A nozzle for atomizing and dispersing a discharge flow of a fluid, and a spacing plate for use in the nozzle is disclosed. The nozzle includes a bonnet, including an inlet port for receiving the fluid in the nozzle, and a first surface extending outward from the inlet port. The nozzle includes at least one deflector base, including a second surface arranged opposite to the first surface. At least one spacing plate is arranged between the first surface of the bonnet and the second surface of the deflector base. The spacing plate includes at least one gap extending through the spacing plate in its perpendicular direction (P) and extending from the outer periphery of the spacing plate to a distance (D) towards the inner section of the spacing plate. A discharge port is fluidly connected to the inlet port allowing the fluid to flow from the inlet port to surroundings of the nozzle. The discharge port is created between the first and the second surface and defined by the at least one gap of the spacing plate.

13 Claims, 3 Drawing Sheets

(51) Int. Cl.

| | |
|---|---|
| ***A62C 37/11*** | (2006.01) |
| ***A62C 99/00*** | (2010.01) |
| *B05B 7/08* | (2006.01) |

(58) Field of Classification Search
CPC ..... A62C 35/60; A62C 35/62; B05B 1/14; B05B 1/26; B05B 1/265; B05B 1/267; B05B 7/0892; B05B 1/3006
See application file for complete search history.

(56) References Cited

U.S. PATENT DOCUMENTS

| | | | | |
|---|---|---|---|---|
| 5,143,657 | A * | 9/1992 | Curtis | B05B 1/265 261/DIG. 11 |
| 5,865,256 | A | 2/1999 | Pounder | |
| 6,745,847 | B2 * | 6/2004 | Kim | B05B 1/14 169/37 |
| 2004/0195359 | A1 | 10/2004 | Curtis | |
| 2011/0315406 | A1 * | 12/2011 | Connery | A62C 35/64 169/37 |
| 2014/0076585 | A1 | 3/2014 | Abels et al. | |
| 2017/0281998 | A1 * | 10/2017 | Cerruti | B05B 1/14 |

FOREIGN PATENT DOCUMENTS

| | | | | |
|---|---|---|---|---|
| CN | 105263587 | A | 1/2016 | |
| CN | 109414604 | A | 3/2019 | |
| DK | 3257589 | T3 | 3/2020 | |
| EP | 3 257 589 | B1 | 12/2019 | |
| IT | WO20160595561 | * | 4/2016 | A62C 31/05 |
| JP | S59-93457 | U | 6/1984 | |
| JP | H08-509653 | A | 10/1996 | |
| JP | H11-99220 | A | 4/1999 | |
| JP | 2012-040165 | A | 3/2012 | |
| JP | 6665347 | B2 | 3/2020 | |
| KR | 10-2019-0017922 | A | 2/2019 | |
| WO | 94/25176 | A1 | 11/1994 | |
| WO | 2005/123263 | A1 | 12/2005 | |
| WO | 2008/067421 | A2 | 6/2008 | |
| WO | 2014/047499 | A2 | 3/2014 | |
| WO | 2017/216081 | A1 | 12/2017 | |

OTHER PUBLICATIONS

Written Opinion for PCT/EP2017/064216 dated Aug. 18, 2017.
Search Report for European Patent Application No. 16174161 dated Dec. 6, 2016.
First Office Action received for Chinese Patent Application Serial No. 201780036669.8 dated Apr. 3, 2020, 20 pages (Including English Translation).
Intention to Grant received for EP Patent Application Serial No. 16174161.6 dated Oct. 1, 2019, 39 pages.
Decision to Grant a Patent received for Japanese Patent Application Serial No. 2019-517166 dated Jan. 20, 2020, 5 pages (Including English Translation).
Notification of Reason for Refusal received for Korean Patent Application Serial No. 10-2019-7000704 dated Apr. 9, 2020, 4 pages (Including English translation).
International Preliminary Report on Patentability received for PCT Application Serial No. PCT/EP2017/064216 dated Dec. 27, 2018, 6 pages.

* cited by examiner

NOZZLE AND SPACING PLATE

CROSS-REFERENCE TO RELATED APPLICATIONS

This application is a U.S. National Stage Application of International Patent Application No. PCT/EP2017/064216, filed Jun. 12, 2017, which claims benefit of European Patent Application No. 16174161.6, filed Jun. 13, 2016, both of which are incorporated by reference herein in their entirety.

BACKGROUND

Field

The invention relates to a nozzle for atomizing and dispersing a discharge flow of a fluid.

The invention further relates to a spacing plate for use in the nozzle.

The invention relates more particularly to arrangements for efficiently distributing an atomized fluid via a nozzle throughout a volume filled with air or other gas.

Description of the Related Art

There are a wide variety of fire suppression systems commercially available today. A problem with these is that the nozzles atomizing and dispersing a discharge flow of a fluid have a rather complicated structure and are thus expensive to manufacture and, furthermore, troublesome to be tailored for varying requirements of the application environments.

SUMMARY

Viewed from a first aspect, there can be provided a nozzle for atomizing and dispersing a discharge flow of a fluid, the nozzle comprising

- a bonnet, comprising
  - an inlet port for receiving said fluid in the nozzle
  - a first surface extending outward from the inlet port,
- at least one deflector base, comprising
  - a second surface arranged opposite to the first surface, wherein
- at least one spacing plate being arranged between the first surface of the bonnet and the second surface of the deflector base, the spacing plate comprising
  - at least one gap extending through the spacing plate in its perpendicular direction and extending from the outer periphery of the spacing plate to a distance towards the inner section of the spacing plate, and
- a discharge port fluidly connected to the inlet port allowing said fluid to flow from the inlet port to surroundings of the nozzle, the discharge port being created between the first and the second surface and defined by the at least one gap of the spacing plate.

Thereby a nozzle which is simple and tailorable may be achieved. The capacity and the coverage area of the nozzle are simple to change without need for readjustment of the nozzle body. Thus, for instance, the spacing of the nozzles to be arranged in a room can be optimized in a simple and cost efficient way—even during the installation work in-situ. This way the amount of fluid dispersed through the nozzle or group of nozzles may be optimized.

Viewed from a further aspect, there can be provided a spacing plate for use in the nozzle mentioned above, the spacing plate comprising at least one gap extending through the spacing plate in its perpendicular direction and extending from the outer periphery of the spacing plate to a distance towards the inner section of the spacing plate.

Thereby a space plate which is simple and tailorable may be achieved.

The nozzle and the spacing plate are characterised by what is stated in the characterising parts of the independent claims. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

In an embodiment the spacing plate comprises plurality of gaps.

An advantage is that the fluid may be distributed in many directions.

In an embodiment said first and second surfaces are planar surfaces. An advantage is that the direction and the coverage area of the discharge flow of the nozzle may be optimized.

In an embodiment one of said first and second surfaces is a concave surface and the other of said first and second surfaces is a convex surface.

An advantage is that the atomized and dispersed flow may be directed optimally in surroundings of the nozzle.

In an embodiment the concave and the convex surfaces are conical surfaces.

An advantage is that the surfaces may be easily manufactured.

In an embodiment the spacing plate has been arranged in a coning angle $\alpha$ in relation to the longitudinal axis X of the nozzle, the coning angle $\alpha$ being in range of 0°-180°.

An advantage is that the direction of the discharge flow and the coverage area of the nozzle may be optimized.

In an embodiment the first and/or second surface(s) is/are arranged in contact with the spacing plate on an outer rim area of the spacing plate, and that a cavity is arranged between an inner rim area of the spacing plate and the first and/or second surface(s), said cavity arranged to connect the discharge port to the inlet port.

An advantage is that the flow channel in the nozzle may be created in a simple way.

In an embodiment the nozzle comprises a connecting piece arranged between the spacing plate and the deflector base, and at least one second spacing plate arranged between the connecting piece and the deflector base, the nozzle thus comprising a second set of discharge ports defined by the at least one gap of the second spacing plate.

An advantage is that the atomizing and dispersing capacity of the nozzle may be enhanced.

In an embodiment the spacing plate comprises at least one gap extending through the spacing plate in its perpendicular direction and extending from the outer periphery of the spacing plate to a distance towards the inner section of the spacing plate.

An advantage is that the plate may be manufactured by simple way.

In an embodiment of the spacing plate, the gap narrows towards the outer periphery.

An advantage is that the flow resistance caused by the spacing plate may be lowered, without jeopardizing the atomization of the fluid and without increasing the resistance of the flow. Lower resistance means lower energy consumption, smaller pump and smaller piping which are reducing the costs of the system.

BRIEF DESCRIPTION OF THE DRAWINGS

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1A:
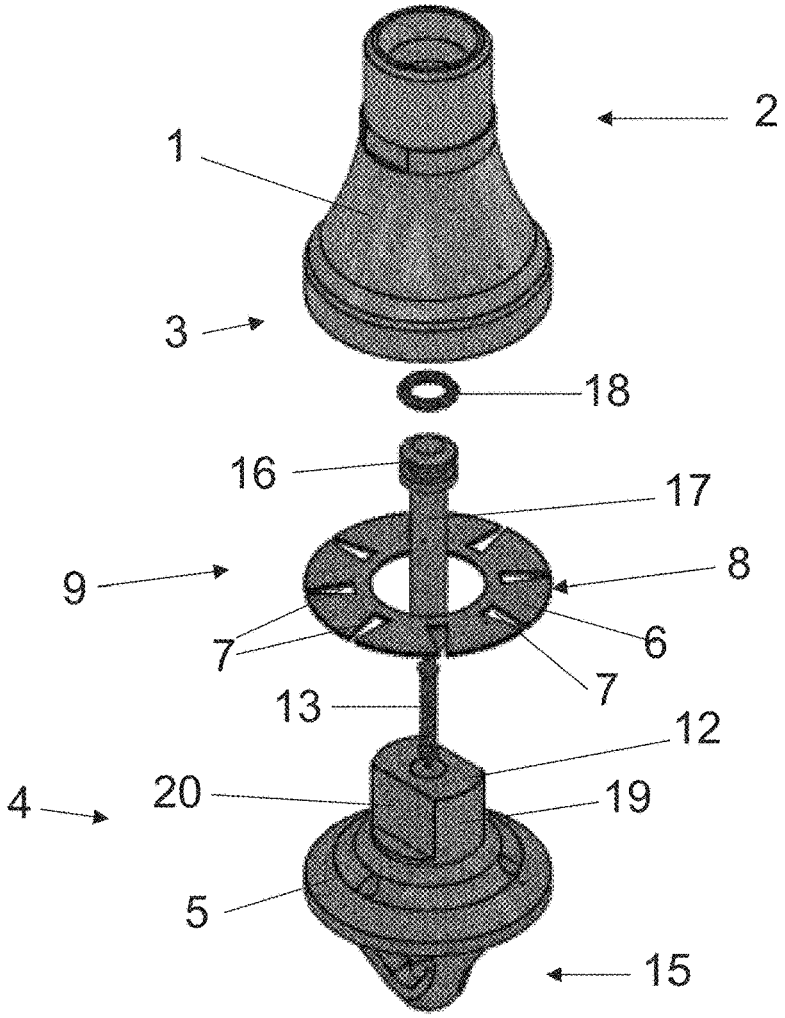
FIG. 1*a* is a schematic exploded view of a nozzle for atomizing and dispersing a discharge flow.
Figure 1B:
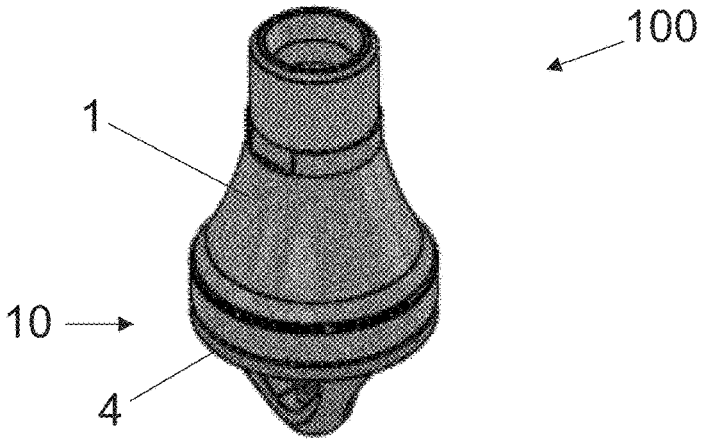
FIG. 1*b* is a view of the nozzle shown in FIG. 1 as assembled.

FIG. 1*a* is a schematic exploded view of a nozzle for atomizing and dispersing a discharge flow, and FIG. 1*b* shows the same nozzle as assembled.

The nozzle 100 is a water spray or water mist nozzle, of a fire suppression system. According to an idea, the nozzle is a sprinkler nozzle. However, the claimed nozzle may be used for other purposes, too.

The fluid to be atomizing and dispersing is water. However, the fluid may be other liquid, or gas, mixture of liquid and/or gas and/or solid particles.

The nozzle 100 comprises a bonnet 1, comprising an inlet port 2 that receives the fluid to be atomized and dispersed. The inlet port 2 may be provided with e.g. a screw thread (not shown) by witch the nozzle 100 can be attached to a fluid piping system (not shown).

The bonnet 1 further comprises a first surface 3 that is arranged at one end of said bonnet 1. An end of the inlet port 2 is situated on the first surface 3 such that the first surface 3 extends outward from said end of the inlet port 2. In the embodiment shown in FIGS. 1*a*, and 1*b*, the inlet port 2 is arranged coaxially with first surface 3 and the first surface 3 extends symmetrically around the end of the inlet port 2. However, it is to be noted that in another embodiments the first surface 3 may extend asymmetrically around the end of the inlet port 2.

The nozzle 100 further comprises a deflector base 4 that comprises a second surface 5. The second surface 5 is situated opposite to the first surface 3 in an assembled nozzle.

In the embodiment shown ion FIGS. 1*a*, 1*b*, the bonnet 1 comprises an internal thread (not shown) and the deflector base 4 comprises an external thread 19 matching to said internal thread. The bonnet 1 is attached to the deflector base 4 by said threads. It is to be noted, however, that the attachment of the bonnet 1 and the deflector base 4 may be arranged other ways, too.

The external thread 19 of the deflector base 4 comprises two parts separated by two cuts 20. The cuts 20 establish a part of flow channel connecting the inlet port 2 to discharge ports 10. The number of the cuts 20 may vary from one cut to three, four or even more cuts. The cut 20 shown in Figures is straight and planar. However the cut 20 may have alternative shapes, e.g. a v-shaped or u-shaped groove, etc.

Between the first surface 3 and the second surface 5 there is arranged at least one spacing plate 6. The embodiment shown in FIGS. 1*a*, 1*b* comprises one spacing plate 6. In other embodiments there are two or even more spacing plates 6 arranged one on the other between the first and the second surfaces 3, 5.

The embodiment of the spacing plate 6 shown in FIG. 1*a* has a round shaped outer periphery 8 and a coaxial aperture 11. Thus the spacing plate 6 has basically an annular shape.

The spacing plate 6 shown in FIG. 1 a comprises eight gaps 7 extending through the spacing plate 6 in its perpendicular direction P and extending a distance D from the outer periphery 8 of the spacing plate 6 towards the inner section 9 of the spacing plate 6.

The spacing plate 6 arranged between the first surface 3 and the second surface 5 keeps said surfaces 3, 5 apart from each other and creates eight discharge ports 10 which are slits or openings on the outer periphery 8 between said surfaces 3, 5. These discharge ports 10 allows the fluid to flow to surroundings of the nozzle 100.

Embodiments of the spacing plate 6 will be described more detailed later in this description.

The nozzle 100 may comprise means for controlling the flow of the fluid therethrough. For this purpose the embodiment shown in FIGS. 1*a*, 1*b* comprises a heat responsive unit 13 supported by a frame arm arrangement 15 known per se. This will be discussed more detailed in description regarding FIGS. 2*a*-3*b*.

The bonnet 1, the deflector base 4 and the spacing plate 6 may be manufactured from any suitable material selected from metals, polymers and composites.

Figure 2A:
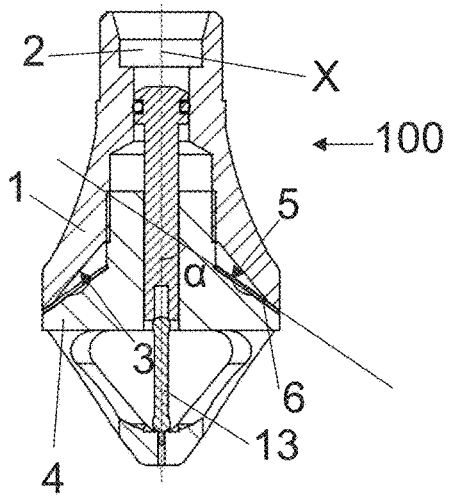
FIGS. 2*a* and 2*b* are cross-sectional side views of the nozzle shown in FIG. 1 in its closed state.
Figure 2B:
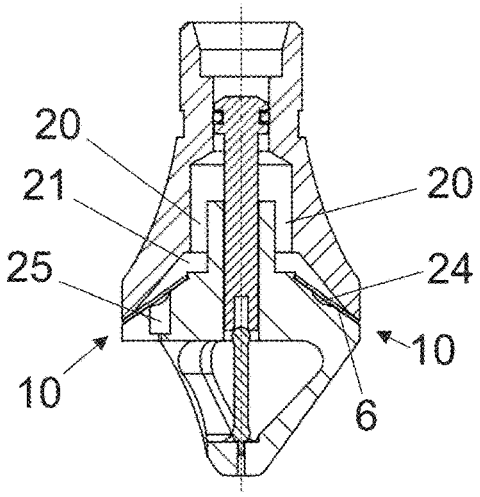
Figure 3A:
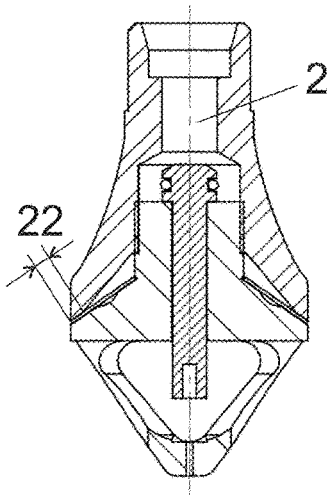
FIGS. 3*a* and 3*b* are cross-sectional side views of the nozzle shown in FIG. 1 in its open state.
Figure 3B:
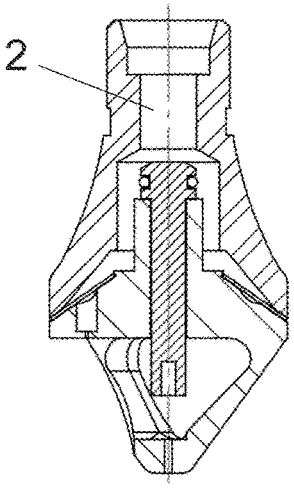

FIGS. 2*a* and 2*b* are cross-sectional side views of the nozzle shown in FIG. 1 in its closed state, and FIGS. 3*a* and 3*b* are cross-sectional side views of the same nozzle in its open state.

The inlet port 2 is arranged to open on the first surface 3 coaxially with the centre of the first surface 3.

In an embodiment, the spacing plate is manufactured as planar or two-dimensional piece of material. Then, the spacing plate 6 is arranged and pressed between the first surface 3 and the second surface 5. Consequently the spacing plate 6 bends and takes a three dimensional shape defined by the first and the second surfaces 3, 5.

In the embodiment shown in FIGS. 2*a*-3*b*, the first surface 3 is a concave surface and the second surface 5 is a convex surface. Furthermore, said surfaces are conical surfaces. The first surface 3 has a sharper coning angle as the second surface 5. Thus it is created a cavity 21 between the first surface 3 and the spacing plate 6. The first surface 3 is pressed against the spacing plate 6 on only an outer rim area 22 of the spacing plate 6, but not in an inner rim area 23 where the spacing plate 6 lies in the cavity 21. The outer rim area 22 is shown in FIG. 3*a*. The width of the outer rim area 22 may be as short as near zero, i.e. the first and second surfaces 3, 5 would make contact only on their utmost edge if arranged against each other. However, in other embodiments, the width of the outer rim area 22 may be more, e.g. several millimetres.

In another embodiment, the second surface 5 has a sharper coning angle as the first surface 3, and thus the cavity 21 is arranged between the spacing plate 6 and the second surface 5. The cavity 21 may e.g. lower the flow resistance in the nozzle.

The cavity 21 connects the inlet port 2 to the gaps 7 and the discharge ports 10.

According to an aspect, the spacing plate 6 has a coning angle α in relation to the longitudinal axis X of the nozzle. 8. In an embodiment, the coning angle α is in range of 0°-180°. In an embodiment, the coning angle α in the rim area 22 is in range of 45°-90°, i.e. from perpendicular angle to biased 45° towards the deflector base 4. In another embodiment, the coning angle α in the rim area 22 is in range of 90°-135°, i.e. from perpendicular angle to biased 45° towards the bonnet 1. The coning angle α in relation to the longitudinal axis X of the nozzle in rim area 22 may often be 35°, 45°, 50°, 55° or 60°. The coning angle α in the rim area 22 in range of 90°±5° may be preferable, too.

In an embodiment, the first and second surfaces 3, 5 are planar surfaces. This means that said surfaces as well as the spacing plate 6 are perpendicular to the longitudinal axis X.

In an embodiment, one of said first and second surfaces 3, 5 is a concave surface and the other of said first and second surfaces 3, 5 is a planar surface.

In the embodiment of the nozzle 100 shown in Figures, there is a circular groove 24 in the second surface 5. The groove 24 may promote distribution of fluid coming from the inlet port 2 and past the cuts 20 in the gaps 7.

Furthermore, the shown embodiment of the nozzle 100 comprises at least one hole 25 that extends from the second surface 5 to a bottom surface of the deflector base 4. These holes serve as flowing channels for allowing some fluid to spray in direction of longitudinal axis X.

The function of the nozzle 100 can be seen when comparing FIGS. 2*a*, 2*b* to FIGS. 3*a*, 3*b*. As the heat responsive unit or frangible heat element 13 breaks and collapses under influence of heat, a plug shaft 17, a plug 16 and a plug seal 18 are allowed to move towards the frame arm arrangement 15. Consequently, fluid pressure prevailing in the fluid piping system (not shown) pushes the plug 16 and the plug seal 18 attached thereto from plugging the inlet port 2. Thus an open flow channel is created extending from the inlet port 2 to the discharge ports 10, and an atomized discharge flow of the fluid is dispersed in surroundings of the nozzle 100.

Figure 4A:
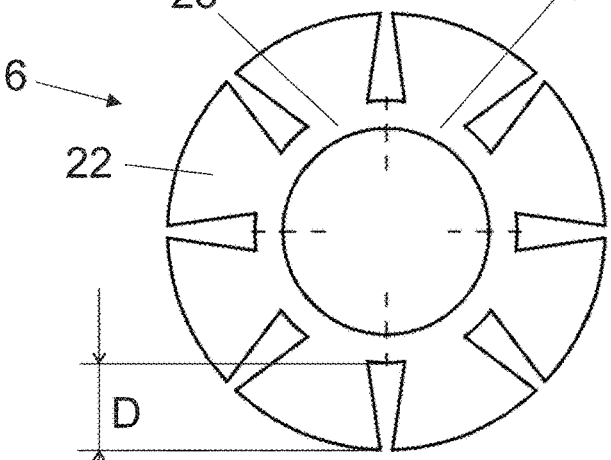
FIGS. 4*a* and 4*b* show schematic top and side views of a spacing plate for use in a nozzle for atomizing and dispersing a discharge flow.
Figure 4B:
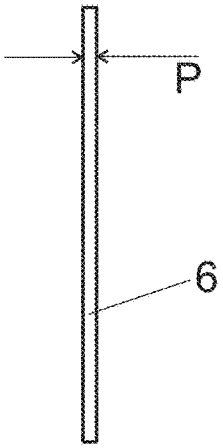

FIG. 4 shows schematic top and side views of a spacing plate for use in a nozzle for atomizing and dispersing a discharge flow.

The basic shape of the spacing plate 6 is round and it comprises a coaxial aperture 11 for receiving a central dowel of the nozzle.

In an embodiment, the spacing plate has a constant thickness. According to an idea, said thickness is in range of 0.01 mm-5 mm, preferably 0.1 mm-0.5 mm.

According to an idea, embodiments for pure water or any other fluids having substantially similar viscosity, the thickness of the spacing plate may be in range of e.g. 0.01 mm-0.5 mm.

According to an idea, embodiments for fluids having substantially higher viscosity, the thickness may be in range of e.g. 0.2 mm-5 mm.

The material of the space plate 6 may be e.g. metal, such as steel, copper, aluminium, or plastic, such as polyolefin, polyamide, polyester, or composite, such as glass-fibre reinforced plastic. The space plate 6 may be manufactured by any method known per se, e.g. by cutting, e.g. laser cutting, stamping, die cutting, casting, moulding, 3D printing, etc.

The embodiment shown in FIG. 4 comprises eight (8) gaps 7 evenly distributed around the spacing plate 6. Consequently, the discharge flow is directed in all directions of the surroundings.

The gap 7 extends through the spacing plate 6 in its perpendicular direction P and extends from the outer periphery 8 of the spacing plate 6 to a distance D towards the inner section 9 of the spacing plate.

According to an idea, the number of the gaps 7 may vary in range of one gap to tens of gaps. In an embodiment of the spacing plate 6, the gap(s) 7 may be arranged not evenly distributed, but there are sections of the outer periphery 8 that comprises more or denser arranged gaps than another section of the same outer periphery 8. In still another embodiment of the spacing plate 6, there are rather broad sections of the outer periphery 8 having no gaps at all. For instance, all the gaps 7 may be arranged in a section the length of which is 25% or 50% of the length of the outer periphery 8. Consequently, the discharge flow can be directed in certain sections of the surroundings.

The gap 7 may narrow towards the outer periphery 8 as in embodiment shown in FIG. 4. In another embodiment, the gap 7 widens towards the outer periphery 8. In still another embodiment, the gap 7 has a constant width. Furthermore, there may be diversely shaped gaps 7 in very same spacing plate 6.

According to an idea, the cross-section of the discharge port 10, i.e. cross sectional area and shape, has an important effect on the amount of dispersed fluid, whereas the shape of the gap 7 mainly effects to the flow resistance and the dispersing pattern, i.e. how the dispersed fluid spreads in the surroundings of the nozzle.

Figure 5A:
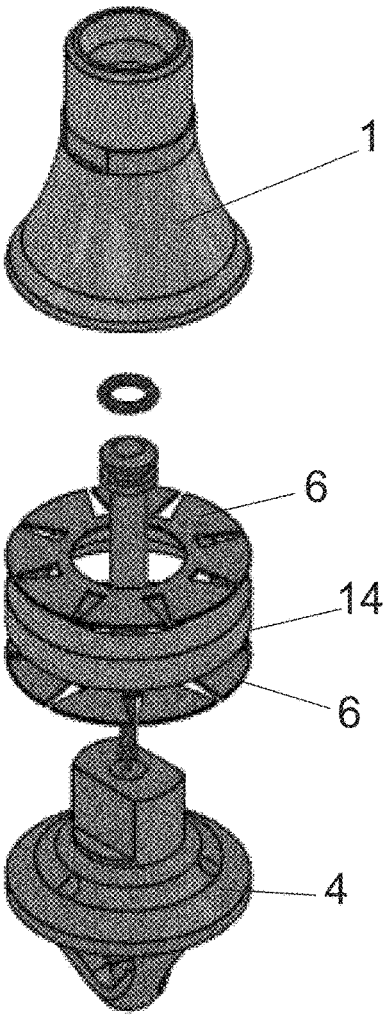
FIGS. 5*a*, 5*b* and 5*c* are schematic views of another nozzle for atomizing and dispersing a discharge flow.
Figure 5C:
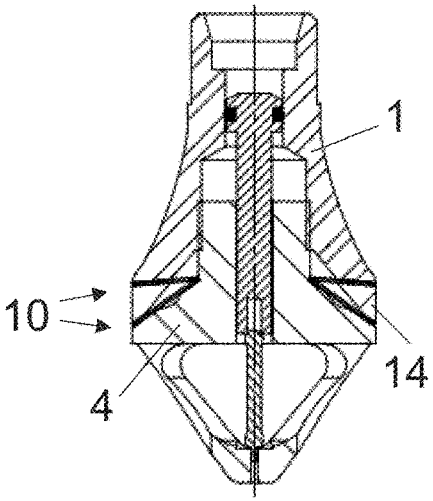
Figure 5B:
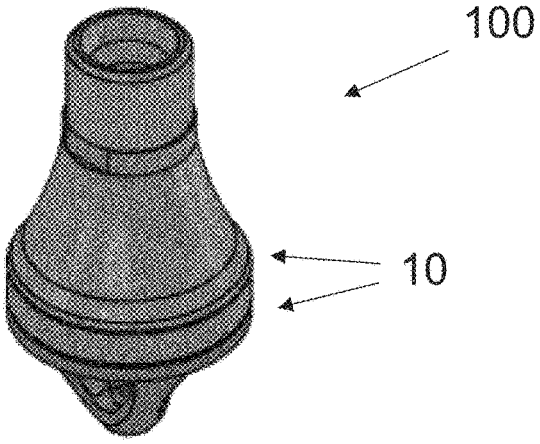

FIG. 5 is a schematic view of another nozzle for atomizing and dispersing a discharge flow. According to an aspect, the nozzle 100 may comprise a connecting piece 14 arranged between the spacing plate 6 and the deflector base 4, and at least one second spacing plate 6 arranged between the connecting piece 14 and the deflector base 4. This means that the nozzle 100 comprises two layers of discharge ports 10, wherein a second set of discharge ports 10 is defined by the gap(s) 7 of the second spacing plate 6. Similarly, in embodiments comprising at least two connecting pieces 14 there are three or even more layers of discharge ports 10. In an embodiment, the coning angles (α) of the layers of the discharge ports 10 are diverse.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 bonnet
2 inlet port
3 first surface
4 deflector base
5 second surface
6 spacing plate
7 gap
8 outer periphery

9 inner section
10 discharge port
11 coaxial aperture
12 central dowel
13 heat responsive unit or frangible heat element
14 connecting piece
15 frame arm arrangement
16 plug
17 plug shaft
18 seal
19 external thread
20 cut
21 cavity
22 outer rim area
23 inner rim area
24 groove
25 hole
100 nozzle
D distance
P perpendicular direction
X longitudinal axis

What is claimed is:

1. A nozzle for atomizing and dispersing a discharge flow of a fluid, the nozzle comprising:

a bonnet comprising an inlet port for receiving said fluid in the nozzle, and a first surface extending outward from the inlet port;

at least one deflector base comprising a second surface arranged opposite to the first surface, wherein at least one spacing plate is arranged between the first surface of the bonnet and the second surface of the at least one deflector base, conically configured about a longitudinal axis of the nozzle, the spacing plate comprising at least one gap extending completely through as an opening in the spacing plate in a direction (P) perpendicular to the second surface of the at least one deflector base and extending from the outer periphery of the spacing plate to a distance (D) towards the inner section of the spacing plate such that the at least one gap is open along at least a portion of a circumferential edge of the spacing plate; and a discharge port fluidly connected to the inlet port allowing said fluid to flow from the inlet port to surroundings of the nozzle, the discharge port being created between the first and the second surfaces and defined by the at least one gap of the spacing plate.

2. The nozzle as claimed in claim 1, wherein the basic shape of the spacing plate is round and the spacing plate comprises a coaxial aperture for receiving a central dowel arranged in the at least one deflector base for attaching to the bonnet.

3. The nozzle as claimed in claim 1, wherein the spacing plate comprises a plurality of the gaps.

4. The nozzle as claimed in claim 1, wherein said first and second surfaces are planar surfaces.

5. The nozzle as claimed in claim 1, wherein one of said first and second surfaces is a concave surface and another of said first and second surfaces is a convex surface.

6. The nozzle as claimed in claim 1, wherein one of said first and second surfaces is a concave surface and another of said first and second surfaces is a planar surface.

7. The nozzle as claimed in claim 5, wherein the concave and the convex surfaces are conical surfaces.

8. The nozzle as claimed in claim 7, wherein the spacing plate is arranged in a coning angle ($\alpha$) in relation to the longitudinal axis (X) of the nozzle, the coning angle ($\alpha$) being in a range of 0°-180°.

9. The nozzle as claimed in claim 5, wherein at least one of the first surface or second surface is arranged in contact with the spacing plate on an outer rim area of the spacing plate, and a cavity is arranged between an inner rim area of the spacing plate and at least one of the first surface or second surface, said cavity arranged to connect the discharge port to the inlet port.

10. The nozzle as claimed in claim 1, wherein the inlet port is arranged to open on the first surface coaxially with the centre of the first surface.

11. The nozzle as claimed in claim 1, wherein the nozzle comprises a connecting piece arranged between the spacing plate and the at least one deflector base, and at least one second spacing plate is arranged between the connecting piece and the at least one deflector base, the nozzle thus comprising at least one second discharge port defined by at least one second spacing plate gap.

12. The nozzle as claimed in claim 1, wherein the nozzle is a sprinkler nozzle of a fire suppression system.

13. The nozzle as claimed in claim 1, wherein the fluid is a liquid.

* * * * *